US010784010B2

(12) United States Patent
Whitehead

(10) Patent No.: US 10,784,010 B2
(45) Date of Patent: Sep. 22, 2020

(54) ELECTRICAL GENERATOR SYSTEM

(71) Applicant: Kinetic Energy Australia Pty. Ltd., Figtree Pocket, Queensland (AU)

(72) Inventor: Steven Whitehead, Mount Samson (AU)

(73) Assignee: KINETIC ENERGY AUSTRALIA PTY. LTD., Queensland (AU)

( * ) Notice: Subject to any disclaimer, the term of this patent is extended or adjusted under 35 U.S.C. 154(b) by 463 days.

(21) Appl. No.: 15/526,012

(22) PCT Filed: Nov. 13, 2015

(86) PCT No.: PCT/AU2015/050712
§ 371 (c)(1),
(2) Date: May 11, 2017

(87) PCT Pub. No.: WO2016/074044
PCT Pub. Date: May 19, 2016

(65) Prior Publication Data

US 2017/0309359 A1 Oct. 26, 2017

(30) Foreign Application Priority Data

Nov. 14, 2014 (AU) ..... 2014904588

(51) Int. Cl.

| | |
|---|---|
| ***G21H 1/06*** | (2006.01) |
| ***G21H 1/00*** | (2006.01) |
| ***G21H 1/02*** | (2006.01) |
| ***G21H 1/04*** | (2006.01) |

(52) U.S. Cl.
CPC ..... *G21H 1/06* (2013.01); *G21H 1/00* (2013.01); *G21H 1/02* (2013.01); *G21H 1/04* (2013.01)

(58) Field of Classification Search
CPC .. G21H 1/00; G21H 1/02; G21H 1/04; G21H 1/06; G21H 1/08
USPC ..... 310/301, 302, 303, 304, 305
See application file for complete search history.

(56) References Cited

U.S. PATENT DOCUMENTS

| | | | | |
|---|---|---|---|---|
| 5,721,462 | A | 2/1998 | Shanks | |
| 6,479,919 | B1 | 11/2002 | Aselage et al. | |
| 2004/0227150 | A1* | 11/2004 | Nakahara | C30B 23/02 257/103 |
| 2011/0298071 | A9* | 12/2011 | Spencer | G21H 1/06 257/429 |
| 2015/0279491 | A1* | 10/2015 | Fenner | G21H 1/02 310/305 |

FOREIGN PATENT DOCUMENTS

JP 2003279691 A 10/2003

* cited by examiner

*Primary Examiner* — Quyen P Leung
*Assistant Examiner* — Alexander A Singh
(74) *Attorney, Agent, or Firm* — Fox Rothschild LLP; Robert J. Sacco; Carol E. Thorstad-Forsyth

(57) ABSTRACT

A power battery using the energy from a radioactive material. The arrangement uses ZnO as a semiconductor, with energy generated a metal-semiconductor junction. The ZnO is arranged in thin layers. This allows for good durability and relatively high power production.

13 Claims, 6 Drawing Sheets

ELECTRICAL GENERATOR SYSTEM

CROSS REFERENCE TO RELATED APPLICATION

The present application is the U.S. National Stage of International Patent Application (PCT) No. PCT/AU2015/050712 filed on Nov. 13, 2015, which claims priority to Australian Patent Application No. 2014904588 filed on Nov. 14, 2014. Both of the above applications are incorporated herein by reference in their entirety.

TECHNICAL FIELD

The present invention relates to the field of electrical generation, and in particular, to electrical energy converted from the energy from radioactive emissions.

BACKGROUND OF THE INVENTION

Power cells provide a self-contained source of electrical energy for driving an external load. A common example of an electrical power cell is an electrochemical battery. While electrochemical batteries are effective at providing power needs for a period of time at a relatively low cost, the limiting factor is the available energy defined by the material type and weight. Due to the limited energy storage and energy density of electrochemical batteries with regard to their mass, there have been various attempts at producing alternative power cells, such as batteries powered by radioactive isotopes due to the higher theoretical limits of energy density.

There are several different types of radioisotope-powered batteries. Once such type is a radio thermal generator (RTG) which uses the heat produced during decay of radioactive material to produce electrical energy. These devices have low conversion efficiency of the heat energy to electrical energy. Accordingly, RTGs are generally used with very high energy radioisotopes to produce a source of electrical power and usually require substantial shielding. In addition, the electrical power output is low.

Another type of radioisotope-powered battery is an indirect conversion device which uses a radioisotope, luminescent material and a photovoltaic cell. The decay particles emitted by the radioisotope excite the luminescent material. The light emitted by the luminescent material is absorbed by the photovoltaic cells to generate electricity. This type of battery generally has low efficiency because of the two step conversion and a relatively short lifespan because the luminescent material is damaged by the emissions.

Another example of a radioisotope powered battery is a direct conversion device which uses a radioisotope and semiconducting material. Conventional semiconductors are of only limited use in this application, as they suffer collateral radiation damage from the radioisotope decay products. In particular, incident high-energy beta particles create defects in the semiconductor that scatter and trap the generated charge carriers. The damage accumulates and thereby over time reduces the performance of the battery.

U.S. Pat. No. 5,260,621 discloses a solid state nuclear battery comprising a relatively high energy radiation source, with concomitant heat generation, and a bulk crystalline semiconductor such as AlGaAs, which is characterised by defect generation in response to the radioisotope. The material is chosen so that radiation damage is repaired by annealing at the elevated operating temperature of the battery. This device suffers from low efficiency, which necessitates the use of a high energy radiation source and also requires elevated operating temperatures to function.

U.S. Pat. No. 5,859,484 teaches a solid state radioisotope-powered semiconductor battery comprising a substrate of crystalline semiconductor material such as GaInAsP. This battery preferably uses a radioisotope that emits only low energy particles to minimise degradation of the semiconductor material in order to maximise lifetime. The effect of using a lower energy radiation source is a lower maximum power output.

A further such device is disclosed in U.S. Pat. No. 6,479,919, which describes a beta cell incorporating icosahedral boride compounds, for example $B_{12}P_2$ or $B_{12}As_2$, a beta radiation source and a means for transmitting electrical energy to an outside load. Manufacturing boron arsenide and boron phosphide is expensive, which increases the cost of producing these types of devices. Further, the production of such devices has increased health, safety and environmental risks associated with handling the arsenide and phosphide materials.

In summary, problems with currently available radioisotope powered cells include inefficiency of conversion of the emitted energy to electrical energy, radiation damage affecting the device materials, shielding requirements for high energy nuclear sources and semiconductor material that is subject to degradation.

It is an object of the present invention to provide a radioisotope power cell which exhibits an improved balance between durability and power output.

SUMMARY OF THE INVENTION

According to the present invention there is provided an electrical generator system including: a radionuclide material; a thin layer of zinc oxide; metal electrodes contacting the zinc oxide and forming a metal-semiconductor junction therebetween, wherein radioactive emissions received from the radionuclide material are converted into electrical energy at the metal-semiconductor junction; and electrical contacts connected to the electrodes which facilitate the flow of the electrical energy when connected to a load.

The use of zinc oxide was found by the inventors to have surprising results. While zinc oxide is an intrinsic n-type semiconductor, it has limited or no commercial applications as a semi-conductor material due to the lack of stable doped p-type ZnO materials. Consequently, it is considered a poor choice of semiconductor material for forming p-n junctions, which has been the primary direction for structuring radioisotope powered cells.

Traditionally accepted choices of semiconductor materials, such as GaAs, GaInAs; or Si, Si—C; or CdTe; etc, have been found to structurally degrade when exposed to high levels of radiation.

The inventor has discovered that zinc oxide, when employed at an appropriate thickness, could withstand high radiation levels and could, when employed as part of a metal-semiconductor junction (as opposed to a p-n junction), give favourable electrical generation output.

BRIEF DESCRIPTION OF THE DRAWINGS

Embodiments of the present invention will now be described with reference to the accompanying drawings, in which.

DETAILED DESCRIPTION OF THE INVENTION

The present invention will be principally described with reference to particular illustrative examples. It will be understood that the principles of the present invention may be implemented using variations of features on the particular implementations illustrated and described. The examples should be considered as illustrative and not limitative of the broad inventive concepts disclosed herein.

One implementation of the present invention is an electrical generation system employing an n-type semiconductor material having metal electrodes in contact with the semiconductor material, and exposing the arrangement to radiation from a radionuclide material. The radioactive emissions are converted into electrical energy at the metal-semiconductor junction formed between the electrodes and the semiconductor material. For flow of generated electrical energy, it is important that there is a potential difference between the electrodes. Hence, there needs to be a significant difference in metal to semiconductor contact area between the electrodes in order that greater charge generation is created at one electrode compared with the other. The electrode having greater charge accumulation effectively becomes the negative terminal and the other electrode becomes the positive terminal.

To maximise electrical generation in a radioisotope power cell, it is desirable to use a relatively high energy level radiation source and a high activity density. However, most semiconductor materials cannot withstand such high energy levels and structurally degrade with exposure.

Zinc oxide is an n-type semiconductor, but is dismissed in the field as being a very poor semiconductor material. However, the present inventor has discovered that zinc oxide does demonstrate a capacity to withstand relatively high energy levels of radiation and high activity density.

Initial tests employing zinc oxide in the proposed electrical generation system unfortunately gave the disappointing results predicted by the accepted opinion in the field, which was that ZnO is a poor semiconductor material. Despite the capacity to withstand high levels of radiation, the generated electrical output was negligible.

However, when tests were conducted on varying the thickness of zinc oxide employed in the proposed electrical generation system, surprisingly favourable results were found when the zinc oxide was provided in the form of a sufficiently thin layer or film. For the purposes of the present description and claims, 'thin' means less than about 15 μm, and preferably less than 10 μm.

Figure 1:
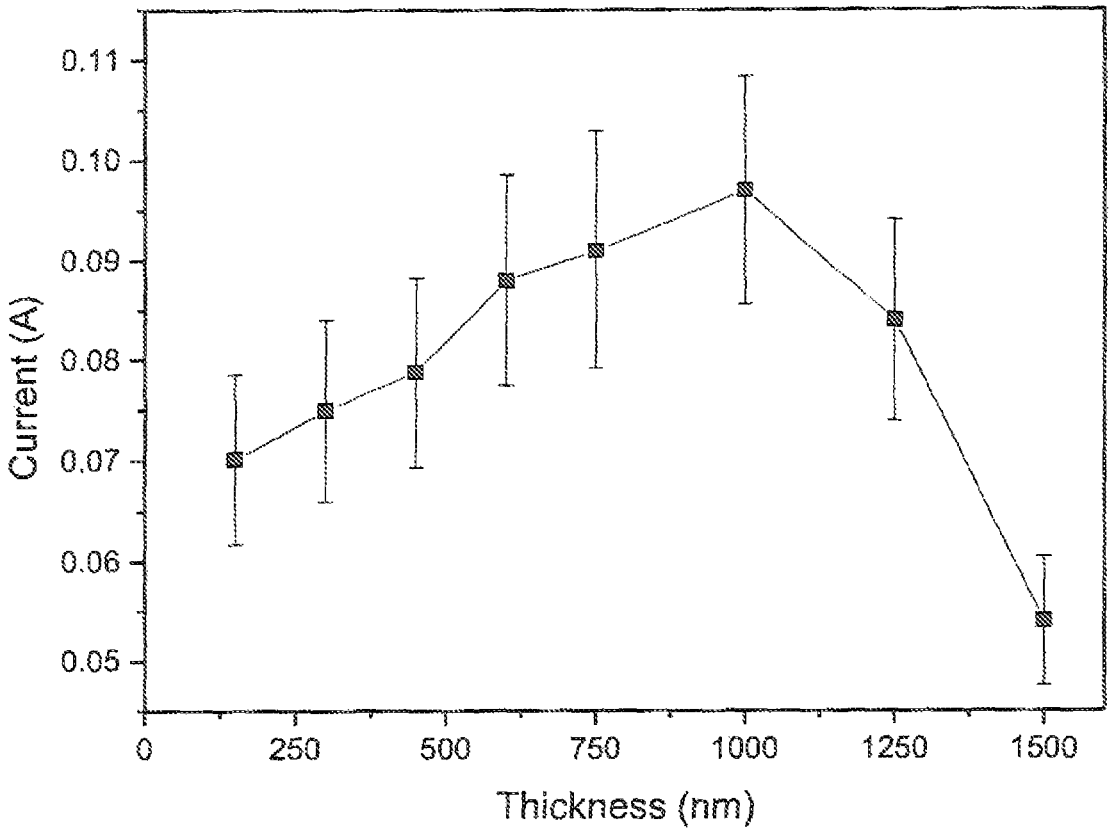
FIG. 1 is a graph showing the variation in generated current with the variation in zinc oxide thickness in tests with an applied voltage of 3V.

FIG. 1 is a graph showing the variation in generated current with the variation in zinc oxide thickness in tests with an applied voltage of 3V. In this test, the optimal current was at 1000 nm.

In practical experiments, a thin film of zinc oxide was formed on a substrate, by rf magnetron sputter or electrochemical vapour deposition, having a 5 cm×5 cm surface. The substrate consisted of a first layer of glass. In this regard, sapphire and quartz are also considered suitable for this first layer. The substrate further consisted of a layer of a doped metal oxide material, which formed the surface upon which the zinc oxide was deposited.

This layer of a doped metal oxide material allowed the smaller positive electrode to be formed thereupon, thereby separating the positive electrode from the zinc oxide but providing a current path due to the semiconductive properties of the doped metal oxide. Suitable doped metal oxide materials include, but are not limited to, fluorine doped tin oxide and tin-doped indium oxide.

A number of metal materials were tested for suitability as electrodes, namely gold, copper, aluminium and silver. In addition, different electrode configurations were examined, a first whereby the electrode covered an entire surface of the zinc oxide layer and a second whereby a comb-like or finger-like grid formation was used on the zinc oxide surface. The general thickness of the metal electrode material was in the range of 100-1000 nm, and preferably 150 nm.

Gold and copper were deposited by using sputtering techniques, while aluminium and silver were deposited using thermal evaporation techniques.

The different samples were exposed to Sr-90. Results found that gold, aluminium and silver produced linear and symmetric current-voltage curves at the metal-semiconductor junction suggesting a desirable degree of ohmic contact between these metals and the zinc oxide.

Copper produced non-linear and asymmetric results, indicative of a Schottky barrier, which suggests that it is unsuitable for the present purposes.

In respect of the different configurations, a negligible difference in results was noted. This suggests that the comb-like grid configuration, which uses less metal, is a viable option. It will be appreciated that other geometries and configurations are contemplated within the scope of the present invention.

Similarly, it will be understood that the present invention could be implemented with different metals, including alloys, in the metal-semiconductor junction.

Tests were conducted with different thicknesses of the zinc oxide layer between 150 nm and 1500 nm.

The surprising results found that as thickness increased from 150 nm the generated electrical output also increased until an optimum thickness, after which, increasing the thickness caused a reduction in generated electrical output. Beyond approximately 1500 nm, the output became too low for practical purposes. Consequently, the tests suggested an ideal thickness range for the zinc oxide to be between 150 nm and 1500 nm. The optimum thickness did vary depending upon selection of materials.

Figure 2:
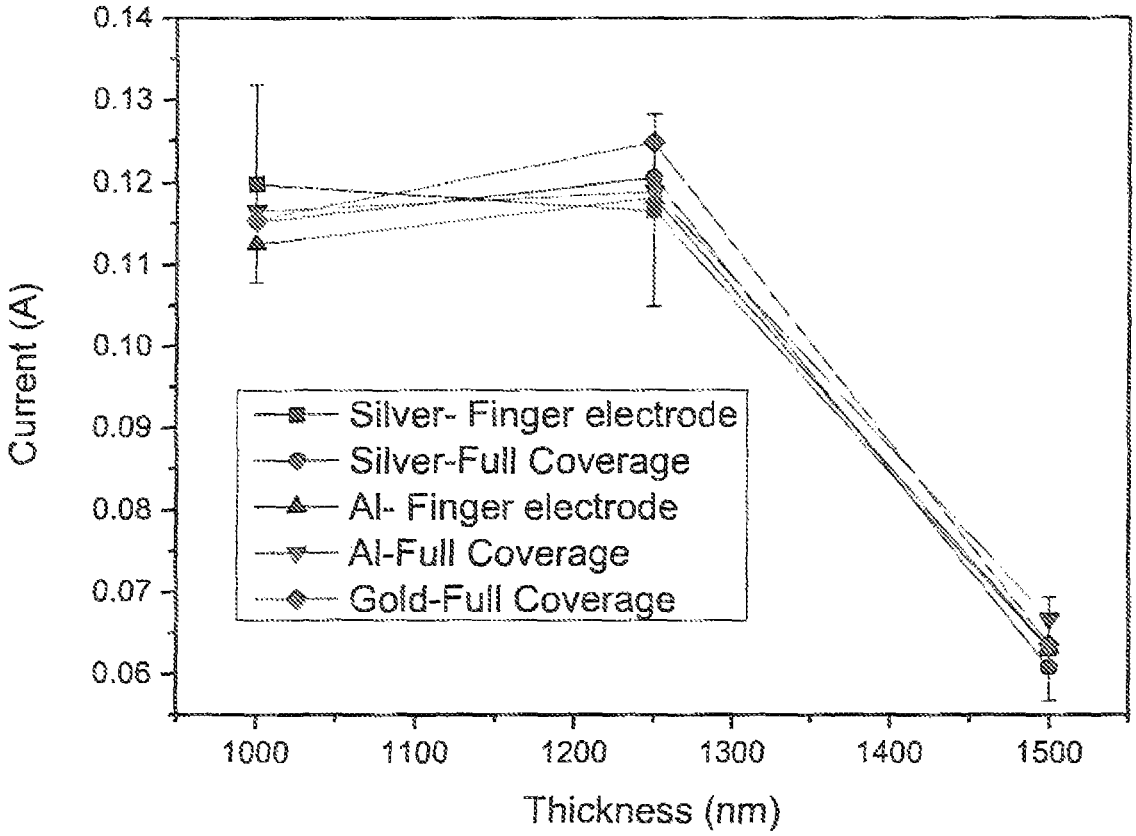
FIG. 2 is a graph showing the variation in generated current with the variation in zinc oxide thickness with different electrode materials and configurations in tests with an applied voltage of 3V.

The optimum thickness did vary depending upon selection of materials. FIG. 2 illustrates the variation in current with thickness at a constant voltage and radiation source, but with different materials and thicknesses of material. The material included silver in a finger electrode configuration; silver in full electrode; aluminium in a finger electrode configuration; aluminium in full coverage; and gold in full coverage.

In certain tests the optimum thickness was 1000 nm while in other tests the optimum thickness was 1250 nm, see FIGS. 1 and 2. Nevertheless, the overall useful range of thicknesses stayed reasonably constant. It is expected that the optimum thickness could also vary, within the range, depending upon the choice of radionuclide material.

Alternative beta emitting materials which could be used in implementations of the present invention include Pm-147, Ni-63 and Tritium, or any other suitable beta emitting material. The present invention is in principle able to use other kinds of radioactive material, for example x-ray sources, gamma sources, or any other suitable material. The radionuclides may be in any suitable chemical form, and the material could in principle be a mixture of different radionuclide or with other materials.

Figure 3:
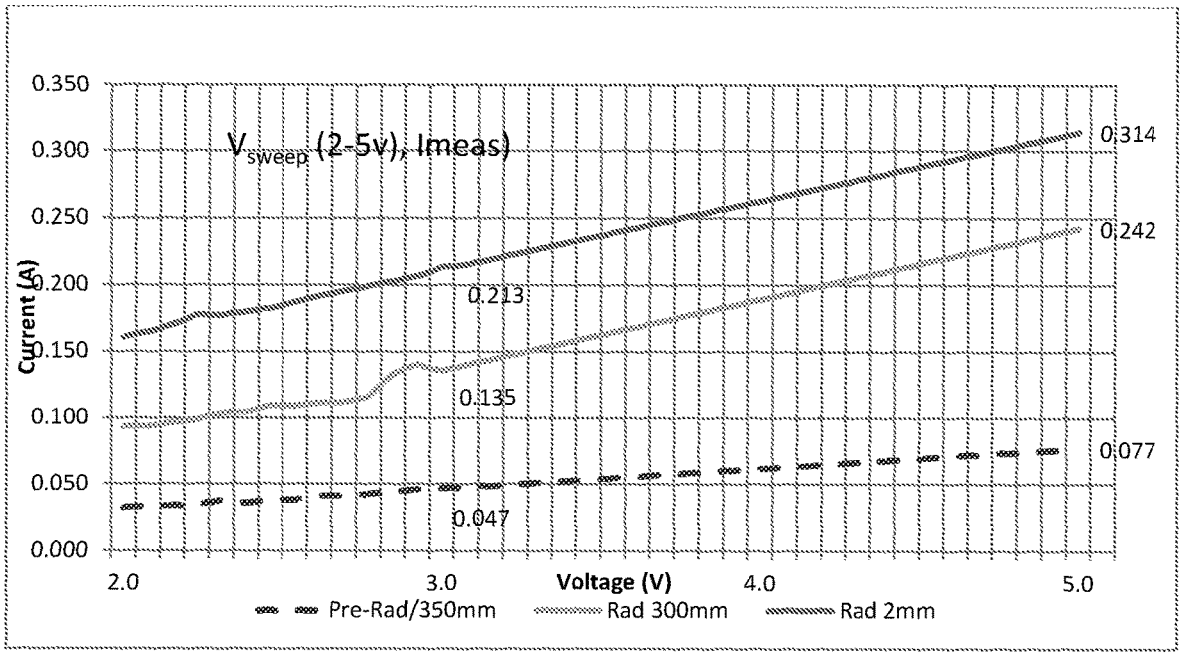
FIG. 3 is a graph showing variation of generated current against applied voltage with varying distance of radionuclide from the zinc oxide layer.

Tests were also conducted on varying the distance and angle of incidence of the Sr-90 material to the zinc oxide layer, varying between 2 mm and 350 mm, shown in FIG. 3. FIG. 3 is a graph showing variation of generated current against applied voltage, with varying distances of the radionuclide from the zinc oxide layer.

As expected, the best output occurred at the smallest distance with output decreasing as distance was increased. Nevertheless there was still appreciable output throughout the tested range, particularly up to approximately 300 mm and an angle of <45°. Given the thickness dimensions of the generator, this is a large space and suggested that a number of generator arrangements could be arranged in a layered structure with the same radionuclide material, thereby increasing the electrical output capacity from a single radionuclide source.

Examples of power supply devices employing the electrical generator system will now be described.

Figure 4:
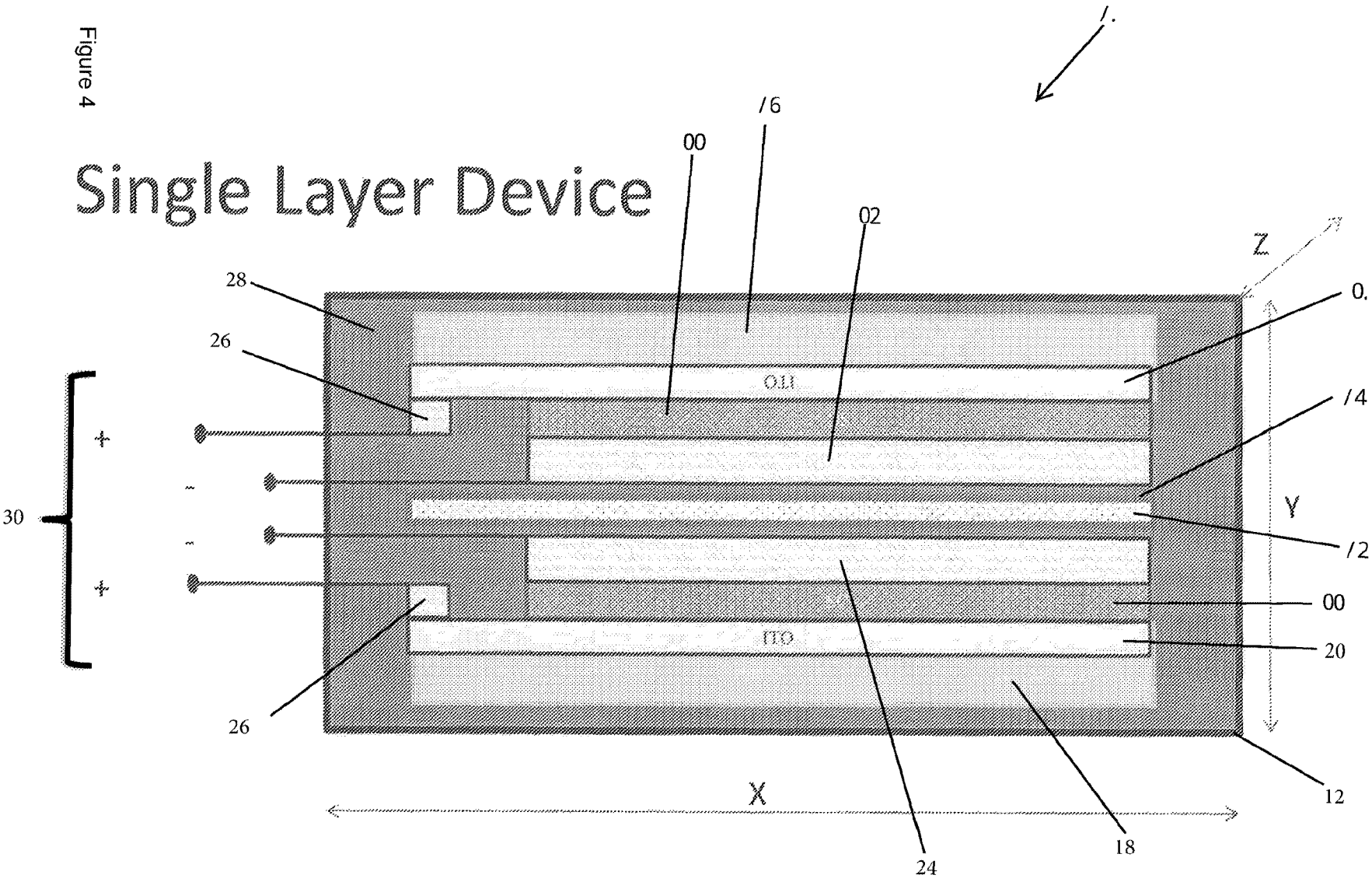
FIG. 4 is schematic view of a first embodiment of a power supply device.

In FIG. 4 there is shown a basic 'single layer' device 10. As shown, the device 10 includes a housing 12, within which at its centre is a layer of a sealed radionuclide 14, for example, Sr-90, Pm-147, Ni-63 or H-3. The housing 12 can be formed of various suitable materials, such as aluminium, steel, etc., and encloses an atmosphere of air 28. The seal 16 can be aluminium, plastic, Mylar, other suitable metal alloy or similar low Z-material (Z being atomic weight). On each side of the radionuclide 14 are substrates 18 (for example, glass substrates) having a layer of tin-doped indium oxide 20 and a thin layer of zinc oxide 22 formed thereupon. An alternative to tin-doped indium oxide can be indium tin fluoride. The main negative electrode 24 is formed on the other surface of the zinc oxide 22 and the smaller positive electrode 26 is formed on a surface of the tin-doped indium oxide 20. Conductive leads 30 are connected to both electrodes 24, 26 and lead to exterior of the housing 12 for connection to a load.

Figure 5:
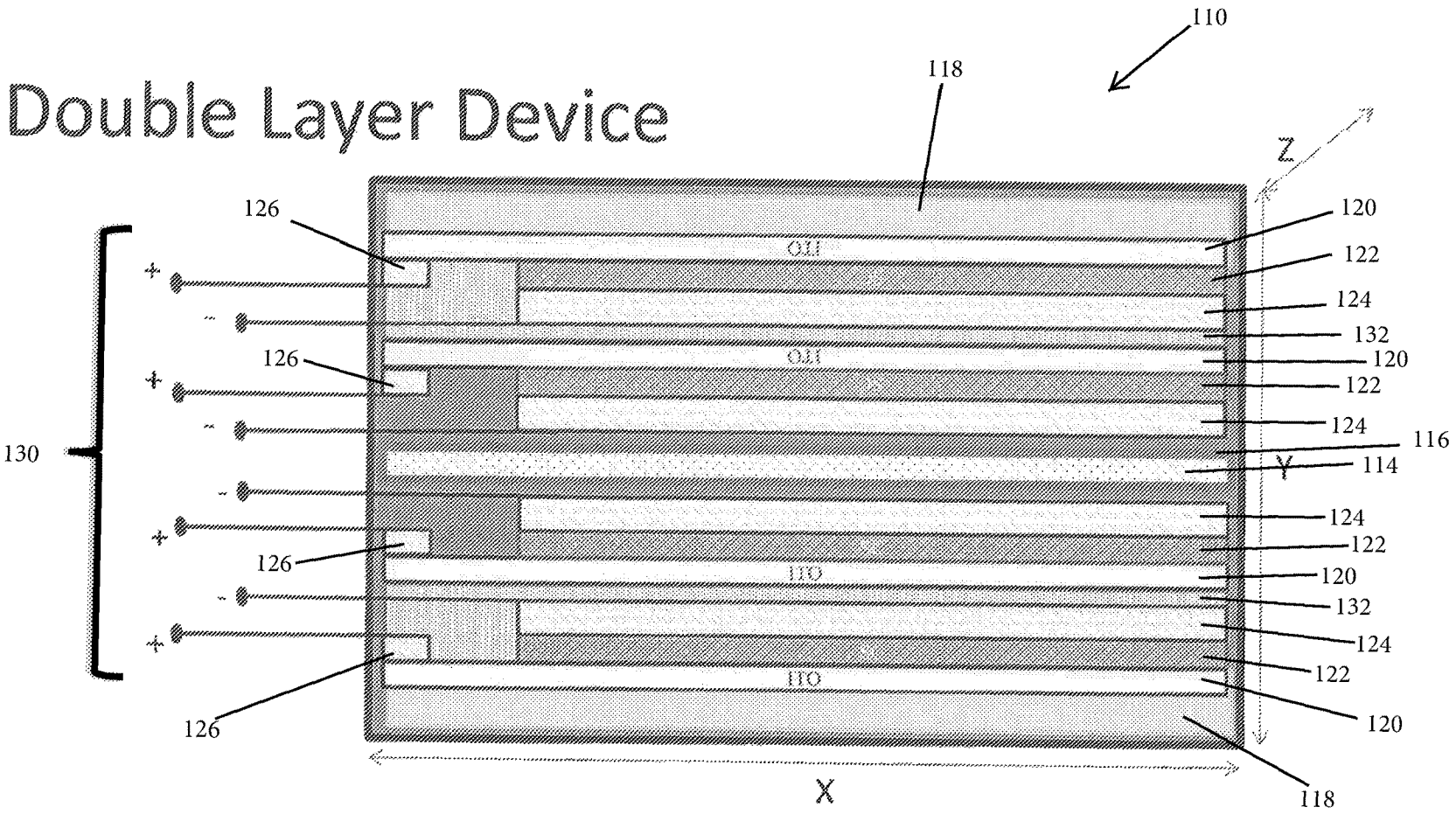
FIG. 5 is a schematic of an alternative embodiment of a power supply device.

In FIG. 5 there is a shown a 'double layer' device 110. Each side of the central radionuclide 114 has an arrangement of two zinc oxide layers 122, each with corresponding electrodes 124, 126, doped metal oxide layers 120 and separated by an insulating substrate 132.

Figure 6:
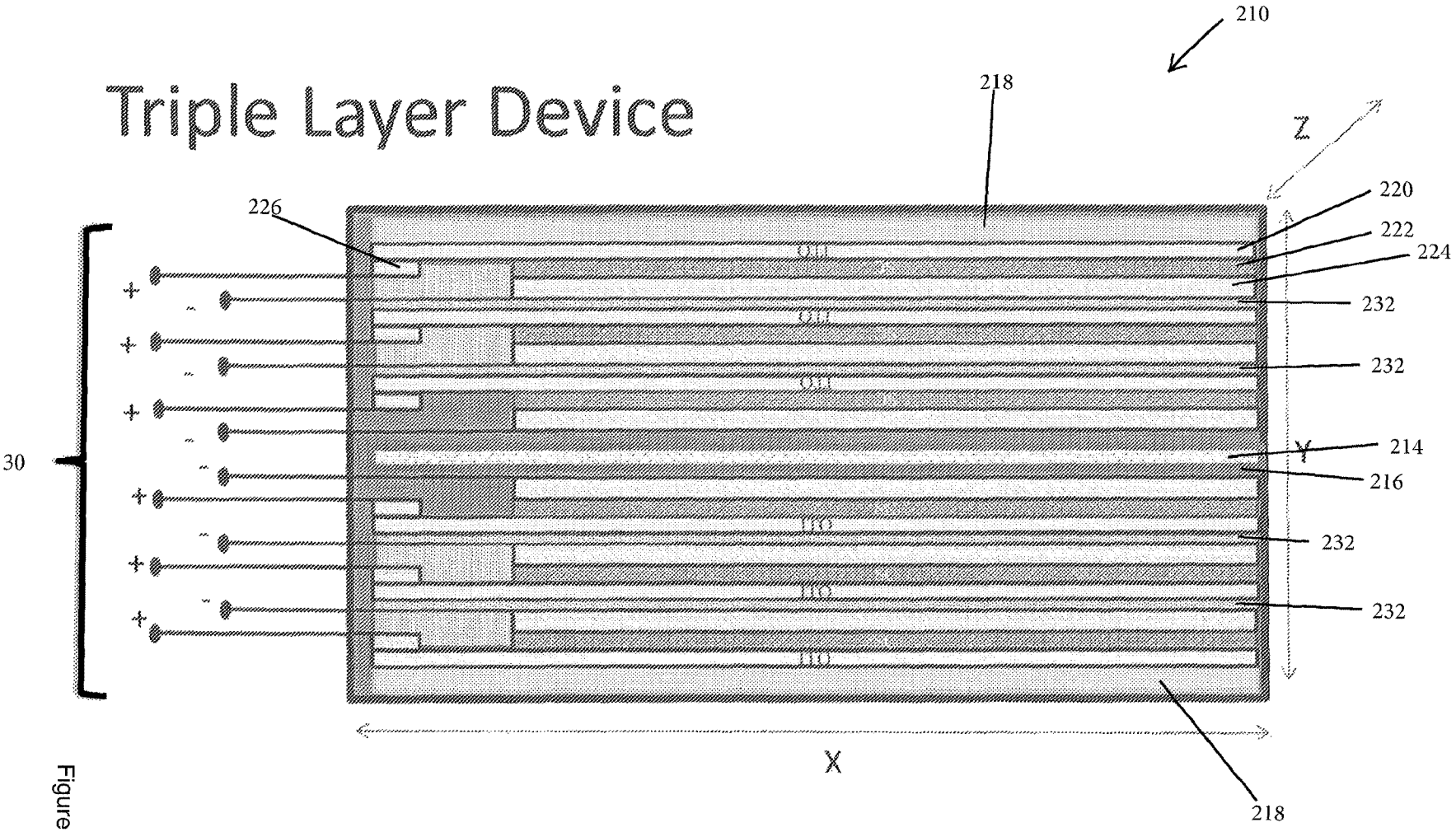
FIG. 6 is a schematic of a further alternative embodiment of a power supply device.

In FIG. 6 there is shown a 'triple layer' device 210, in which layers of substrate and ZnO are arranged in a sandwich arrangement. Similarly to the other examples, a central sealed radionuclide 214 has an arrangement of 3 layers of substrate 232 either side, with ZnO layers 222, doped metal oxide layers 220 and electrodes 224, 226.

As will be appreciated, it is possible to keep increasing the number of layers and, as a consequence, increase generated electrical output. The limit to how many layers can be employed is dictated by how far away from the radionuclide material the furthest layer is.

It will be appreciated that structures with more than one layer of radionuclide may be used, with multiple sandwich structures added to provide a desired power level. It will also be understood that although the structure described is generally square in shape, the structure could be of any desired shape, and could be curved in a suitable implementation, assuming appropriate spacings can be maintained.

The invention claimed is:

1. An electrical generator system including:

a radionuclide material;

metal electrodes; and electrical contacts connected to said metal electrodes, said electrical contacts being adapted to facilitate flow of electrical energy when connected to a load, wherein the system further includes a thin layer of zinc oxide having a thickness between 150-1500 nanometers (nm), said thin layer of zinc oxide being in direct contact with at least one of the metal electrodes and forming a metal-semiconductor junction therebetween, and wherein radioactive emissions received from said radionuclide material are converted into electrical energy at said metal-semiconductor junction.

2. The electrical generator system of claim 1, wherein said zinc oxide layer is formed on a substrate material.

3. The electrical generator system of claim 2, wherein said substrate material is selected from glass, sapphire or quartz.

4. The electrical generator system according to claim 2, wherein a layer of a doped metal oxide material is disposed between the zinc oxide layer and the substrate.

5. The electrical generator system according to claim 4, wherein one of said metal electrodes is disposed in direct contact with said doped metal oxide material.

6. The electrical generator system according to claim 1, wherein said thin layer of zinc oxide is formed by an RF magnetron sputter process.

7. The electrical generator system according to claim 1, wherein said metal electrodes are formed of gold, silver or aluminium.

8. The electrical generator system according to claim 1, wherein said metal electrodes are deposited on said zinc oxide by a sputtering process or electrochemical vapour deposition.

9. The electrical generator system according to claim 1, wherein said radionuclide material is encased in a seal material.

10. The electrical generator system according to claim 9, wherein said seal material is selected from aluminium, a metal alloy, plastic or Mylar.

11. The electrical generator system according to claim 1, wherein said radionuclide material is selected from Sr-90, Pm-147, Ni-63 or H-3.

12. An electrical power supply device including a housing enclosing an electrical generator system according to claim 1.

13. The device of claim 12, wherein there are multiple layers of zinc oxide, each layer having corresponding metal electrodes and electrical contacts, wherein adjacent layers are separated by an insulating substrate material.

* * * * *